US011401482B2

(12) United States Patent
Elliott et al.

(10) Patent No.: US 11,401,482 B2
(45) **Date of Patent: *Aug. 2, 2022**

(54) METHOD FOR PREVENTING OR REDUCING LOW SPEED PRE-IGNITION IN DIRECT INJECTED SPARK-IGNITED ENGINES WITH COBALT-CONTAINING LUBRICANT

(71) Applicants: Chevron Oronite Company LLC, San Ramon, CA (US); Chevron U.S.A. Inc., San Ramon, CA (US)

(72) Inventors: Ian G. Elliott, Vacaville, CA (US); Richard E. Cherpeck, Cotati, CA (US); Amir Gamal Maria, Vallejo, CA (US); Theresa Liang Gunawan, Richmond, CA (US)

(73) Assignees: CHEVRON ORONITE COMPANY LLC, San Ramon, CA (US); CHEVRON U.S.A. INC., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/130,408

(22) Filed: Sep. 13, 2018

(65) Prior Publication Data

US 2019/0078033 A1 Mar. 14, 2019

Related U.S. Application Data

(60) Provisional application No. 62/558,047, filed on Sep. 13, 2017.

(51) Int. Cl.

| | |
|---|---|
| ***C10M 141/00*** | (2006.01) |
| ***C10M 141/08*** | (2006.01) |
| ***C10M 141/12*** | (2006.01) |
| *C10N 10/04* | (2006.01) |
| *C10N 10/12* | (2006.01) |
| *C10N 10/14* | (2006.01) |
| *C10N 30/04* | (2006.01) |
| *C10N 40/25* | (2006.01) |
| *C10N 10/16* | (2006.01) |

(52) U.S. Cl.

CPC ..... *C10M 141/08* (2013.01); *C10M 141/12* (2013.01); *C10M 2203/1025* (2013.01); *C10M 2205/02* (2013.01); *C10M 2207/028* (2013.01); *C10M 2207/126* (2013.01); *C10M 2207/262* (2013.01); *C10M 2215/064* (2013.01); *C10M 2215/28* (2013.01); *C10M 2215/30* (2013.01); *C10M 2219/046* (2013.01); *C10M 2223/045* (2013.01); *C10M 2227/066* (2013.01); *C10N 2010/04* (2013.01); *C10N 2010/12* (2013.01); *C10N 2010/14* (2013.01); *C10N 2010/16* (2013.01); *C10N 2030/04* (2013.01); *C10N 2040/255* (2020.05)

(58) Field of Classification Search

CPC ..... C10M 141/08; C10M 141/12; C10M 2223/045; C10M 2215/064; C10M 2215/28; C10M 2207/028; C10M 2205/02; C10M 2207/262; C10M 2227/066; C10M 2203/1025; C10M 2219/046; C10M 2207/126; C10M 2215/30; C10N 2230/04; C10N 2240/104; C10N 2210/06; C10N 2210/02; C10N 2210/08

See application file for complete search history.

(56) References Cited

U.S. PATENT DOCUMENTS

| | | | | |
|---|---|---|---|---|
| 3,172,892 | A | 3/1965 | Le Suer et al. | |
| 3,219,666 | A | 11/1965 | Norman et al. | |
| 3,272,746 | A | 9/1966 | Le Suer et al. | |
| 4,151,100 | A | 4/1979 | Braid | |
| 4,252,674 | A | 2/1981 | Smith | |
| 4,320,019 | A | 3/1982 | Hayashi | |
| 6,372,696 | B1 | 4/2002 | Tipton | |
| 7,648,949 | B2 | 1/2010 | Vilardo et al. | |
| 7,884,058 | B2 | 2/2011 | Nelson et al. | |
| 2006/0166842 | A1* | 7/2006 | Vilardo | C10M 141/06 508/363 |
| 2018/0194707 | A1* | 7/2018 | Burrows | C07C 57/12 |

FOREIGN PATENT DOCUMENTS

| | | | | |
|---|---|---|---|---|
| JP | 2017119789 | | 7/2017 | |
| WO | 2015021129 | A1 | 2/2015 | |
| WO | 2015042340 | | 3/2015 | |
| WO | WO-2015042341 | A1 * | 3/2015 | C10M 169/04 |
| WO | WO-2017005967 | A1 * | 1/2017 | C10M 159/18 |

OTHER PUBLICATIONS

Lubricant Reactivity Effects on Gasoline Spark Ignition Engine Knock, Amann et al. SAE 2012-01-1140).

* cited by examiner

*Primary Examiner* — Taiwo Oladapo

(57) ABSTRACT

Disclosed is a method for preventing or reducing low speed pre-ignition in an engine lubricated with a formulated oil. The formulated oil has a composition comprising at least one oil soluble or oil dispersible cobalt-containing compound.

14 Claims, No Drawings

METHOD FOR PREVENTING OR REDUCING LOW SPEED PRE-IGNITION IN DIRECT INJECTED SPARK-IGNITED ENGINES WITH COBALT-CONTAINING LUBRICANT

FIELD OF THE INVENTION

This disclosure relates to a lubricant composition for a direct injected, boosted, spark ignited internal combustion engine that contains at least one cobalt compound. This disclosure also relates to a method for preventing or reducing low speed pre-ignition in an engine lubricated with a formulated oil. The formulated oil has a composition comprising at least one oil soluble or oil dispersible cobalt compound.

BACKGROUND OF THE INVENTION

One of the leading theories surrounding the cause of low speed pre-ignition (LSPI) is at least in part, due to auto-ignition of engine oil droplets that enter the engine combustion chamber from the piston crevice under high pressure, during periods in which the engine is operating at low speeds, and compression stroke time is longest (Amann et al., SAE 2012-01-1140).

Although some engine knocking and pre-ignition problems can be and are being resolved through the use of new engine technology, such as electronic controls and knock sensors, and through the optimization of engine operating conditions, there is a role for lubricating oil compositions which can decrease or prevent the problem.

The present inventors have discovered a solution for addressing the problem of LSPI through the use of cobalt-containing additives.

SUMMARY OF THE INVENTION

In one aspect, the present disclosure provides a method for preventing or reducing low speed pre-ignition in a direct injected, boosted, spark ignited internal combustion engine, said method comprising the step of lubricating the crankcase of the engine with a lubricating oil composition comprising from about 25 to about 3000 ppm of metal from at least one cobalt-containing compound, based on the total weight of the lubricating oil.

In one aspect, the cobalt-containing compound is a cobalt alkoxide compound, colloidal dispersion of a cobalt salt, cobalt amido compound, cobalt acetylacetonate compound, cobalt branched and saturated carboxylate compound, cobalt salicylate compound, cobalt arylsulfonate compound, cobalt sulfurized or unsulfurized phenate compound, bis(cyclopentadienyl)cobalt compound, dithiocarbamato cobalt complex, dithiophosphato cobalt complex, salen cobalt complex, phosphate ester, phospinate, or phosphinite cobalt complex, pyridyl, polypyridyl, or quinolinolato or isoquinolato cobalt complex, glyoximato cobalt complex, alkyldiamino cobalt complex, azamacrocyclic cobalt complex, cobalt alkylsufonate compound, cobalt basic nitrogen succinimide complex, cobalt sulfanyl alkanoate, or cobalt colloidal suspension.

In another aspect, the present disclosure provides a lubricating engine oil composition for a direct injected, boosted, spark ignited internal combustion engine comprising from about 25 to about 3000 ppm of metal from at least one cobalt-containing compound, based on the total weight of the lubricating oil.

In another aspect, the present disclosure provides a lubricating engine oil composition for a port fuel injected, boosted, spark ignited internal combustion engine comprising from about 25 to about 3000 ppm of metal from at least one cobalt-containing compound, based on the total weight of the lubricating oil.

DETAILED DESCRIPTION OF THE INVENTION

Definitions

The term "boosting" is used throughout the specification. Boosting refers to running an engine at higher intake pressures than in naturally aspirated engines. A boosted condition can be reached by use of a turbocharger (driven by exhaust) or a supercharger (driven by the engine). Using smaller engines that provide higher power densities has allowed engine manufacturers to provide excellent performance while reducing frictional and pumping losses. This is accomplished by increasing boost pressures with the use of turbochargers or mechanical superchargers, and by downsizing the engine by using higher transmission gear ratios allowed by higher torque generation at lower engine speeds. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure. The possibility of LSPI prevents engine manufacturers from fully optimizing engine torque at lower engine speed in such smaller, high-output engines Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The term "sulfated ash" as used herein refers to the non-combustible residue resulting from detergents and metallic additives in lubricating oil. Sulfated ash may be determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test. Unless otherwise specified, all percentages are in weight percent.

In general, the level of sulfur in the lubricating oil compositions of the present invention is less than or equal to about 0.7 wt. %, based on the total weight of the lubricating oil composition, e.g., a level of sulfur of about 0.01 wt. % to about 0.70 wt. %, 0.01 to 0.6 wt. %, 0.01 to 0.5 wt. %, 0.01 to 0.4 wt. %, 0.01 to 0.3 wt. %, 0.01 to 0.2 wt. %, 0.01 wt. % to 0.10 wt. %. In one embodiment, the level of sulfur in the lubricating oil compositions of the present invention is less than or equal to about 0.60 wt. %, less than or equal to about 0.50 wt. %, less than or equal to about 0.40 wt. %, less than or equal to about 0.30 wt. %, less than or equal to about 0.20 wt. %, less than or equal to about 0.10 wt. % based on the total weight of the lubricating oil composition.

In one embodiment, the levels of phosphorus in the lubricating oil compositions of the present invention is less than or equal to about 0.12 wt. %, based on the total weight of the lubricating oil composition, e.g., a level of phosphorus of about 0.01 wt. % to about 0.12 wt. %. In one embodiment, the levels of phosphorus in the lubricating oil compositions of the present invention is less than or equal to about 0.11 wt. %, based on the total weight of the lubricating oil composition, e.g., a level of phosphorus of about 0.01 wt. % to about 0.11 wt. %. In one embodiment, the levels of phosphorus in the lubricating oil compositions of the present invention is less than or equal to about 0.10 wt. %, based on the total weight of the lubricating oil composition, e.g., a level of phosphorus of about 0.01 wt. % to about 0.10 wt. %. In one embodiment, the levels of phosphorus in the lubricating oil compositions of the present invention is less than or equal to about 0.09 wt. %, based on the total weight of the lubricating oil composition, e.g., a level of phosphorus of about 0.01 wt. % to about 0.09 wt. %. In one embodiment, the levels of phosphorus in the lubricating oil compositions of the present invention is less than or equal to about 0.08 wt. %, based on the total weight of the lubricating oil composition, e.g., a level of phosphorus of about 0.01 wt. % to about 0.08 wt. %. In one embodiment, the levels of phosphorus in the lubricating oil compositions of the present invention is less than or equal to about 0.07 wt. %, based on the total weight of the lubricating oil composition, e.g., a level of phosphorus of about 0.01 wt. % to about 0.07 wt. %. In one embodiment, the levels of phosphorus in the lubricating oil compositions of the present invention is less than or equal to about 0.05 wt. %, based on the total weight of the lubricating oil composition, e.g., a level of phosphorus of about 0.01 wt. % to about 0.05 wt. %.

In one embodiment, the level of sulfated ash produced by the lubricating oil compositions of the present invention is less than or equal to about 1.60 wt. % as determined by ASTM D 874, e.g., a level of sulfated ash of from about 0.10 to about 1.60 wt. % as determined by ASTM D 874. In one embodiment, the level of sulfated ash produced by the lubricating oil compositions of the present invention is less than or equal to about 1.00 wt. % as determined by ASTM D 874, e.g., a level of sulfated ash of from about 0.10 to about 1.00 wt. % as determined by ASTM D 874. In one embodiment, the level of sulfated ash produced by the lubricating oil compositions of the present invention is less than or equal to about 0.80 wt. % as determined by ASTM D 874, e.g., a level of sulfated ash of from about 0.10 to about 0.80 wt. % as determined by ASTM D 874. In one embodiment, the level of sulfated ash produced by the lubricating oil compositions of the present invention is less than or equal to about 0.60 wt. % as determined by ASTM D 874, e.g., a level of sulfated ash of from about 0.10 to about 0.60 wt. % as determined by ASTM D 874.

Suitably, the present lubricating oil composition may have a total base number (TBN) of 4 to 15 mg KOH/g (e.g., 5 to 12 mg KOH/g, 6 to 12 mg KOH/g, or 8 to 12 mg KOH/g).

Low Speed Pre-Ignition is most likely to occur in direct-injected, boosted (turbocharged or supercharged), spark-ignited (gasoline) internal combustion engines that, in operation, generate a break mean effective pressure level of greater than about 15 bar (peak torque), such as at least about 18 bar, particularly at least about 20 bar at engine speeds of from about 1500 to about 2500 rotations per minute (rpm), such as at engine speeds of from about 1500 to about 2000 rpm. As used herein, break mean effective pressure (BMEP) is defined as the work accomplished during one engine cycle, divided by the engine swept volume; the engine torque normalized by engine displacement. The word "brake" denotes the actual torque/power available at the engine flywheel, as measured on a dynamometer. Thus, BMEP is a measure of the useful power output of the engine.

In one embodiment of the invention, the engine is operated at speeds between 500 rpm and 3000 rpm, or 800 rpm to 2800 rpm, or even 1000 rpm to 2600 rpm. Additionally, the engine may be operated with a break mean effective pressure of 10 bars to 30 bars, or 12 bars to 24 bars.

LSPI events, while comparatively uncommon, may be catastrophic in nature. Hence drastic reduction or even elimination of LSPI events during normal or sustained operation of a direct fuel injection engine is desirable. In one embodiment, the method of the invention is such that there are less than 15 LSPI events per 100,000 combustion events or less than 10 LSPI events per 100,000 combustion events. In one embodiment, there may be less than 5 LSPI events per 100,000 combustion events, less than 4 LSPI events per 100,000 combustion events, less than 3 LSPI events per 100,000 combustion events, less than 2 LSPI events per 100,000 combustion events, less than 1 LSPI event per 100,000 combustion events, or there may be 0 LSPI events per 100,000 combustion events.

Therefore, in an aspect the present disclosure provides a method for preventing or reducing low speed pre-ignition in a direct injected, boosted, spark ignited internal combustion engine, said method comprising the step of lubricating the crankcase of the engine with a lubricating oil composition comprising at least one cobalt-containing compound. In one embodiment, the amount of metal from the at least one cobalt compound is from about 25 to about 3000 ppm, from about 50 to about 3000 ppm, from about 100 to about 3000 ppm, from about 200 to about 3000 ppm, from about 250 to about 2500 ppm, from about 300 to about 2500 ppm, from about 350 to about 2500 ppm, from about 400 ppm to about 2500 ppm, from about 500 to about 2500 ppm, from about 600 to about 2500 ppm, from about 700 to about 2500 ppm, from about 700 to about 2000 ppm, from about 700 to about 1500 ppm in the lubricating oil composition. In one embodiment, the amount of metal from the cobalt-containing compound is no more than about 2000 ppm or no more than 1500 ppm in the lubricating oil composition.

In one embodiment, the method of the invention provides a reduction in the number of LSPI events of at least 10 percent, or at least 20 percent, or at least 30 percent, or at least 50 percent, or at least 60 percent, or at least 70 percent, or at least 80 percent, or at least 90 percent, or at least 95 percent, compared to an oil that does not contain the at least one cobalt-containing compound.

In another aspect, the present disclosure provides a method for reducing the severity of low speed pre-ignition events in a direct injected, boosted, spark ignited internal combustion engine, said method comprising the step of lubricating the crankcase of the engine with a lubricating oil composition comprising at least one cobalt-containing compound. LSPI events are determined by monitoring peak cylinder pressure (PP) and mass fraction burn (MFB) of the fuel charge in the cylinder. When either or both criteria are met, it can be said that an LSPI event has occurred. The threshold for peak cylinder pressure varies by test, but is typically 4-5 standard deviations above the average cylinder pressure. Likewise, the MFB threshold is typically 4-5 standard deviations earlier than the average MFB (represented in crank angle degrees). LSPI events can be reported as average events per test, events per 100,000 combustion cycles, events per cycle, and/or combustion cycles per event. In one embodiment, the number of LSPI events, where both MFB02 and Peak Pressure (PP) Requirements that were greater than 90 bar of pressure, is less than 5 events, less than 4 events, less than 3 events, less than 2 events, or less than 1 event. In one embodiment, the number of LSPI events that were greater than 90 bar was zero events, or in other words completely suppressed LSPI events greater than 90 bar. In one embodiment, the number of LSPI events where both MFB02 and Peak Pressure (PP) Requirements that were greater than 100 bar of pressure is less than 5 events, less than 4 events, less than 3 events, less than 2 events, or less than 1 event. In one embodiment, the number of LSPI events that were greater than 100 bar was zero events, or in other words completely suppressed LSPI events greater than 100 bar. In one embodiment, the number of LSPI events where both MFB02 and Peak Pressure (PP) Requirements that were greater than 110 bar of pressure is less than 5 events, less than 4 events, less than 3 events, less than 2 events, or less than 1 event. In one embodiment, the number of LSPI events that were greater than 110 bar was zero events, or in other words completely suppressed LSPI events greater than 110 bar. For example, the number of LSPI events where both MFB02 and Peak Pressure (PP) Requirements that were greater than 120 bar of pressure is less than 5 events, less than 4 events, less than 3 events, less than 2 events, or less than 1 event. In one embodiment, the number of LSPI events that were greater than 120 bar was zero events, or in other words completely suppressed very severe LSPI events (i.e., events greater than 120 bar). It has now been found that the occurrence of LSPI in engines susceptible to the occurrence of LSPI can be reduced by lubricating such engines with lubricating oil compositions containing a cobalt-containing compound.

The disclosure further provides the method described herein in which the engine is fueled with a liquid hydrocarbon fuel, a liquid nonhydrocarbon fuel, or mixtures thereof.

The disclosure further provides the method described herein in which the engine is fueled by natural gas, liquefied petroleum gas (LPG), compressed natural gas (CNG), or mixtures thereof.

Lubricating oil compositions suitable for use as passenger car motor oils conventionally comprise a major amount of oil of lubricating viscosity and minor amounts of performance enhancing additives, including ash-containing compounds. Conveniently, cobalt is introduced into the lubricating oil compositions used in the practice of the present disclosure by one or more cobalt containing compounds.

Oil of Lubricating viscosity/Base Oil Component

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-diene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Group I base oils generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

Group III base oils generally refer to a petroleum derived lubricating base oil having less than 300 ppm sulfur, a saturates content greater than 90 weight percent, and a VI of 120 or greater.

Group IV base oils are polyalphaolefins (PAOs).

Group V base oils include all other base oils not included in Group I, II, III, or IV.

The lubricating oil composition can contain minor amounts of other base oil components. For example, the lubricating oil composition can contain a minor amount of a base oil derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude.

Suitable natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Suitable synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

Other useful fluids of lubricating viscosity include nonconventional or unconventional base stocks that have been processed, preferably catalytically, or synthesized to provide high performance lubrication characteristics.

Cobalt Compound

The lubrication oil compositions herein can contain one or more cobalt-containing compounds. Those skilled in the art will recognize suitable additives have been described in Nicholls, "The Chemistry of Iron, Cobalt and Nickel," 1st Edition, Pergamon Press, Elsevier, (1975), which is incorporated herein by reference. The cobalt complexes described in this disclosure are typically prepared by reacting a cobalt reactant with a suitable ligand using methods apparent to a practitioner of ordinary skill in the art. Typically, these cobalt reactants are represented by the following compounds: $Co_2(CO)_8$, $CoCl_2$, $CoBr_2$, $CoCl_2(PPh_3)_2$, $C(OH)_2$, $Co(CO_3)$, $CO(SO_4)$, $(NH_4)_2Co(SO_4)_2$, CoO, $Co_2O_3$, $Co_3O_4$, $Co_4S_4$, $Co(NO_3)_2$, $CoMoO_4$, $K_3[Co(CN)_6]$, $Co_2B$, $Co_2P$, $Co(NO_2)_2$, $Co(OAc)_2$, and $Co(acac)_2$ or similar cobalt compounds. The cobalt reactants may have various levels of hydration or oxidation states (e.g., $CO^{II}$, $CO^{III}$) present. Additionally, the cobalt reactants can have mixture of ligand chemistries to complete its valency. Any one of these cobalt compounds described above can be used as the cobalt compound of the present disclosure. Preferred cobalt compounds are $CoCl_2$, $Co(OH)_2$, $Co(CO_3)$, and $Co(acac)_2$. The cobalt reactants can also be the cobalt compound of the present disclosure. The cobalt complexes described herein are oil-soluble or oil dispersible.

In one embodiment, the cobalt compound can be a cobalt alkoxide compound. For example, the cobalt alkoxides can be of the form $Co^{\alpha}(OR_A)_nL_X$ where $\alpha$ is the +2 or +3 oxidation state, $R_A$ is a linear, cyclic, or branched, saturated or unsaturated, aliphatic hydrocarbon moiety having from 1 to about 30 carbon atoms, n is an integer from 0 to 3, L is absent or a ligand that saturates the coordination sphere of cobalt, and x is an integer from 0 to 6. In certain embodiments the ligand, L, is selected from the group consisting of water, hydroxide, oxo, phosphine, phosphite, phosphate, ammonia, amino, amido, imino, pyridyl, sulfate, thioether, sulfide, thiolate, halide, carboxylate, and combinations thereof. In certain embodiments, the cobalt alkoxide could be a dimer or higher order multinuclear complex, and the substituents $OR_A$ or L may be bridging (μ) ligands. Examples include, but are not limited to cobalt (II) or cobalt(III) 2-ethylhexanol, cobalt(II) or cobalt(III) n-butoxide, ccobalt(II) or cobalt(III) tridecylalcohol, and combinations thereof.

In one embodiment, the cobalt compound can be a colloidal dispersion of a cobalt salt. For example, cobalt salts can comprise of repeating $[Co^{\alpha}\text{-}X\text{-}Co^{\alpha}]_n$ units, where α is the +2 or +3 oxidation state, and X is selected from the group consisting of water, hydroxide, alkoxide, oxo, oxide, phosphine, phosphite, phosphate, ammonia, amino, sulfate, thioether, sulfide, thiolate, halide, carboxylate, and combinations thereof. To assist in the dispersion of the colloidal particles, a solubilizing agent can be added. For example, U.S. Pat. No. 4,252,674 teaches that hydroxyl-terminated co-poly(styrene/butadiene), poly(butadiene), or co-poly(styrene/para-styryldiphenylphosphine) polymers produce homogenous stable colloidal suspensions of cobalt when combined with a suitable cobalt precursor at a suitable temperature, and is incorporated herein by reference. In some embodiments, a solvent can be added, which include examples such as methanol, ethanol, butanol, N,N-dimethylformamide, N-N, dimethylacetamide, acetonitrile, N-methyl-2-pyrrolidone, glycerol, ethylene glycol, oligomeric glycol ethers, or combinations thereof. Generally, the amount of the colloidal dispersion of cobalt salt can be from about 0.01 wt. % to about 5 wt. %.

In one embodiment, the cobalt compound can be a cobalt amido compound. For example, the cobalt amido compound can be of the form $Co^{\alpha}(NR_B)_nL_X$ where α is the +2 or +3 oxidation state, $R_B$ is a linear, cyclic, or branched, and saturated or unsaturated, aliphatic hydrocarbon moiety having from 1 to about 30 carbon atoms, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, imino, pyridyl, sulfate, thioether, sulfide, thiolate, halide, carboxylate, carboxylic acid dervatives, and combinations thereof In certain embodiments, the cobalt amido compound could be a dimer or higher order multinuclear complex, and the substituents $NR_B$ or L may be bridging (μ) ligands. In one embodiment, the cobalt compound can be a cobalt acetylacetonate compound. For example, the cobalt acetylacetonate is of the following Formula 1:

(Formula 1)

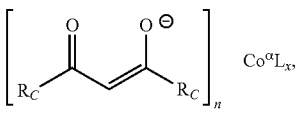

where α is the +2 or +3 oxidation state, $R_C$ can be a symmetric or asymmetric linear, cyclic, or branched, saturated or unsaturated, aliphatic hydrocarbon moiety having from 1 to about 30 carbon atoms, or an aromatic moiety, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, pyridyl, sulfate, thioether, sulfide, thiolate, halide, carboxylate, and combinations thereof. In certain embodiments, the cobalt acetylacetonate compound could be a dimer or higher order multinuclear complex, and the substituents L may be bridging (μ) ligands.

In one embodiment, the cobalt compound can be a cobalt carboxylate compound. For example, the cobalt carboxylate is of the following Formula 2:

(Formula 2)

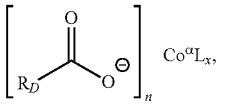

where α is the +2 or +3 oxidation state, $R_D$ is a branched and saturated aliphatic hydrocarbon moiety having from 1 to about 30 carbon atoms, or aromatic and alkylaromatic rings with alkyl groups that can be linear, cyclic, or branched, and saturated, aliphatic hydrocarbon moiety having from 1 to about 30 carbon atoms, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, imino, pyridyl, sulfate, thioether, sulfide, thiolate, halide, and combinations thereof. In one embodiment, the branching group is next to the carboxylate moiety. In certain embodiments, the cobalt carboxylate compound could be a dimer or higher order multinuclear complex, and the substituents $R_DCO_2$- or L may be bridging (μ) ligands. For example, the cobalt carboxylate can be cobalt (II) 2-ethylhexanoate In one embodiment, the cobalt compound can be a cobalt salicylate compound. For example, the cobalt carboxylate is of the following Formula 3:

(Formula 3)

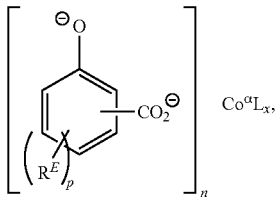

where α is the +2 or +3 oxidation state, $R_E$ is a hydrogen atom, a linear, cyclic, or branched, saturated or unsaturated, aliphatic hydrocarbon moiety having from 1 to about 40 carbon atoms, p is an integer from 1 to 4, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, imino, pyridyl, sulfate, thioether, sulfide, thiolate, halide, and combinations thereof. In certain embodiments, the cobalt salicylate compound could be a dimer or higher order multinuclear complex, and the salicylate substituent or L may be bridging (μ) ligands. In some embodiments, alkali earth metals such as magnesium, calcium, strontium, and barium may be added. Alkali earth metals are typically basic salts which can include, but are not limited to, metal oxides, metal hydroxides, metal alkoxides, metal carbonates, and metal bicarbonates.

In another embodiment, the cobalt compound can be a cobalt arylsulfonate compound. For example, the cobalt arylsufonate is of the following Formula 4:

(Formula 4)

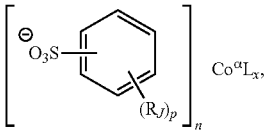

where α is the +2 or +3 oxidation state, each $R_J$ is a hydrogen atom, a linear, cyclic, or branched, saturated or unsaturated, aliphatic hydrocarbon moiety having from 1 to about 40 carbon atoms, p is an integer from 1 to 5, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof. In certain embodiments, the cobalt arylsulfonate could be a dimer or higher order multinuclear complex, and the arylsulfonate substituent or L may be bridging (μ) ligands. In some embodiments, alkali earth metals such as magnesium, calcium, strontium, and barium may be added. Alkali earth metals are typically basic salts which can include, but are not limited to, metal oxides, metal hydroxides, metal alkoxides, metal carbonates, and metal bicarbonates.

In one embodiment, the cobalt compound can be a cobalt sulfurized or unsulfurized phenate compound. For example, the cobalt sulfurized or unsulfurized phenate is of the following Formula 5:

(Formula 5)

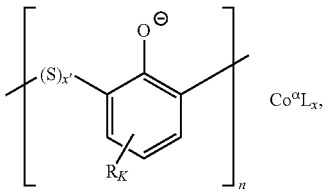

where α is the +2 or +3 oxidation state, $R_K$ is a hydrogen atom, a linear, cyclic, or branched, saturated or unsaturated, aliphatic hydrocarbon moiety having from 1 to about 40 carbon atoms, x' is 0 or an integer from 1 to about 8, n is an integer from 1 to about 15, L is absent or a ligand that saturates the coordination sphere of cobalt, and x is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, pyridyl, sulfate, thioether, sulfide, thiolate, halide, carboxylate, and combinations thereof. In certain embodiments, the cobalt sulfurized or unsulfurized phenate could be a dimer or higher order multinuclear complex, and the sulfurized or unsulfurized phenate substituent or L may be bridging (μ) ligands. In some embodiments, the sulfurized or unsulfurized cobalt phenates could resemble the cobalt thiobis (alkylphenolates) as described by U.S. Pat. No. 4,151,100, which is included herein bys reference.

In one embodiment, the cobalt compound can be a bis (cyclopentadienyl)cobalt compound. Other related cobalt metallocene complexes are known to a person of ordinary skill in the art and may be used in the lubricating oil compositions disclosed herein. For example, the cobalt metallocene is of the following Formula 6:

(Formula 6)

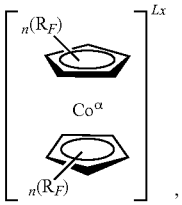

where α is the +2 or +3 oxidation state, each $R_F$ is a hydrogen atom, a linear, cyclic, or branched, saturated or unsaturated, aliphatic hydrocarbon moiety having from 1 to about 30 carbon atoms, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof.

In one embodiment, the cobalt compound can be a dithiocarbamato cobalt complex. For example, the cobalt dithiocarbamatate is of Formula 7:

(Formula 7)

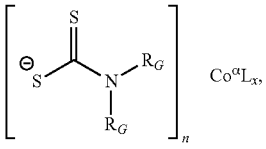

where α is the +2 or +3 oxidation state, each $R_G$ is independently a linear, cyclic, or branched, saturated or unsaturated, aliphatic hydrocarbon moiety having from 1 to about 30 carbon atoms, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof. In certain embodiments, the dithiocarbamato cobalt complex could be a dimer or higher order multinuclear complex, and the dithiocarbamate substituent or L may be bridging (μ) ligands. In some embodiments, the cobalt dithocarbamate compound could resemble the cobalt complexes described in U.S. Pat. No. 7,648,949, which is included herein by reference. In one embodiment, the cobalt compound can be a dithiophosphato cobalt complex. For example, the cobalt dithiophosphate is of Formula 8:

(Formula 8)

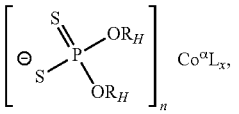

where α is the +2 or +3 oxidation state, each $R_H$ is independently a linear, cyclic, or branched, saturated or unsaturated, aliphatic hydrocarbon moiety having from 1 to about 30 carbon atoms, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, pyridyl, sulfate, thioether, sulfide, thiolate, halide, carboxylate, and combinations thereof. In certain embodiments, the dithiophosphato cobalt complex could be a dimer or higher order multinuclear complex, and the dithiophosphate substituent or L may be bridging (μ) ligands. In some embodiments, the dithiophosphate cobalt complex resembles those described in U.S. Pat. No. 7,648,949. In one embodiment, the cobalt compound can be a salen cobalt complex. For example, the cobalt salen is of Formula 9:

(Formula 9)

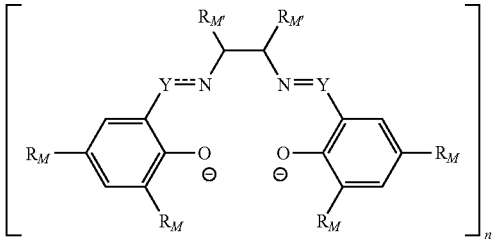

where α is the +2 or +3 oxidation state, each $R_M$ is independently a hydrogen atom, or a linear, cyclic, or branched, saturated or unsaturated, hydrocarbon moiety having from 1 to about 40 carbon atoms, each Y is independently —$C(R_{M''})_z$ where each $R_{M''}$ is a hydrogen atom, a linear, cyclic, or branched, saturated or unsaturated, aliphatic hydrocarbon moiety having from 1 to about 20 carbon atoms, or an aromatic ring, z is 1 or 2 when each N is imido or amino, respectively, each $R_{M'}$ is independently a hydrogen atom, a linear, cyclic, or branched, saturated or unsaturated, aliphatic chains hydrocarbon moiety having from 1 to about 20 carbon atoms, or taken together with the atoms to which they are connected form a 5-, 6-, or 7-membered ring (can be aromatic, completely saturated, or contain varying levels of unsaturation), n is an integer of 1, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof. In certain embodiments, the cobalt salen complex can resemble the cobalt salicyaldimines described in U.S. Pat. No. 7,648,949.

In one embodiment, the cobalt compound can be a phosphate ester, phosphinate, or phosphinite cobalt complex. For example, the cobalt phosphate esters, phosphite, phospinates, or phosphinites are of the following Formula 10:

(Formula 10)

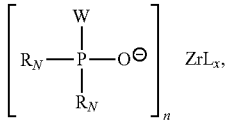

where α is the +2 or +3 oxidation state, W is an oxo or an unbonded pair of electrons when the phosphorous atom is in the +3 or +5 oxidation state, respectively, each $R_N$ is independently a linear, cyclic, or branched, saturated or unsaturated, aliphatic hydrocarbon moiety having from 1 to about 30 carbon atoms, an aromatic ring or an alkoxide moiety, an ether of the formula $OR_N'$, where $R_{N'}$ is independently a linear, cyclic, or branched, saturated or unsaturated, aliphatic hydrocarbon moiety having from 1 to about 30 carbon atoms, or an aromatic ring, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof. In certain embodiments, the phosphate ester, phospinate, or phosphinite cobalt complex could be a dimer or higher order multinuclear complex, and the phosphate ester, phospinate, or phosphinite substituents or L may be bridging (μ) ligands. In one embodiment, the cobalt compound can be pyridyl, polypyridyl, quinolinolato, and isoquinolinolato cobalt complexes. For example, pyridyl, polypyridyl, quinolinolato, isoquinolinolato complexes of cobalt are of the following Formula 11:

(Formula 11)

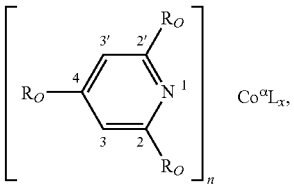

where α is the +2 or +3 oxidation state, each $R_O$ is independently a hydrogen atom or a linear, cyclic, or branched, saturated or unsaturated, aliphatic hydrocarbon moiety having from 1 to about 40 carbon atoms, or a pyridyl ring typically substituted at the 2 position which can be unfuctionalized or can be connected to the other functionalized pyridyl rings to make fused ring systems commonly referred to 8-hydroxyquinolines, quinolines, isoquinolines, or phenanthrolines, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, sulfate, thioether, sulfide, thiolate, halide, carboxylate, and combinations thereof. In certain embodiments, the pyridyl, polypyridyl, quinolinolato, and isoquinolato cobalt complexes could be a dimer or higher order multinuclear complex, and the pyridyl, polypyridyl, quinolinolate, isoquinolinate substituents or L may be bridging (μ) ligands. In one embodiment, the cobalt compound can be a glyoximato cobalt complex. For example, glyoximato complexes of cobalt are of the following Formula 12:

(Formula 12)

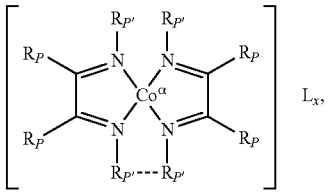

where α is the +2 or +3 oxidation state, each $R_p$ is independently a hydrogen atom or a linear, cyclic, or branched, saturated or unsaturated, aliphatic hydrocarbon moiety having from 1 to about 20 carbon atoms, each $R_{P'}$ is independently a hydrogen atom, a hydroxyl group, a ether moiety of the form —$OR_{p''}$ where $R_{P''}$ is a linear, cyclic, or branched, saturated or unsaturated, aliphatic hydrocarbon moiety having from 1 to about 20 carbon atoms, or a linear, cyclic, or branched, saturated or unsaturated, aliphatic chains hydrocarbon moiety having from 1 to about 20 carbon atoms that can connect together in some embodiments, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, pyridyl, sulfate, thioether, sulfide, thiolate, halide, carboxylate, and combinations thereof.

In one embodiment, the cobalt compound can be an alkyldiamino cobalt complex. For example, the alkyldiamino cobalt compounds are of the following Formula 13:

(Formula 13)

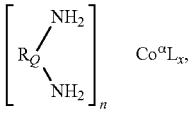

where α is the +2 or +3 oxidation state, $R_Q$ is a linear, cyclic, or branched, saturated or unsaturated, aliphatic hydrocarbon moiety having from 1 to about 10 carbon atoms, an aromatic ring, or could compose of repeating —$[(C(R_{Q'})_a)_bH]_c(C(R_{Q'})_a)_b$- units, where $R_{Q'}$ is independently a hydrogen atom, a linear, cyclic, or branched, saturated or unsaturated, aliphatic hydrocarbon moiety having from 1 to about 30 carbon atoms, a is independently an integer from 0 to 2, b is an integer from 0 to 5, H is a heteroatom such as O, S, or $NR_{Q''}$, c is an integer from 0 to 10, n is an integer from 0 to 3, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof In certain embodiments, the alkyldiamino cobalt complex could be a dimer or higher order multinuclear complex, and the alkyldiamino substituents or L may be bridging (μ) ligands.

In one embodiment, the cobalt compound can be an azamacrocyclic cobalt complex. An example could be a cobalt porphyrin complex and the like. For example, the azamacrocyclic cobalt compounds are of the following Formula 15:

(Formula 15)

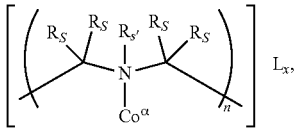

where α is the +2 or +3 oxidation state, $R_S$ is independently a hydrogen atom, or a linear, cyclic, or branched, saturated or unsaturated, aliphatic hydrocarbon moiety having from 1 to about 10 carbon atoms, where $R_{S'}$ is independently a hydrogen atom, a linear, cyclic, or branched, saturated or unsaturated, aliphatic hydrocarbon moiety having from 1 to about 30 carbon atoms, or a p-toluenesulfonamide, n is an integer from 3 to 6, L is absent or a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, imino, pyridyl, sulfate, thioether, sulfide, thiolate, halide, carboxylate, and combinations thereof. In another embodiment, the cobalt compound can be a cobalt alkylsulfonate complex. For example, the cobalt alkylsufonate is of the following Formula 16:

(Formula 16)

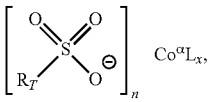

where α is the +2 or +3 oxidation state, each $R_T$ is a linear, cyclic, or branched, saturated or unsaturated, aliphatic hydrocarbon moiety having from 1 to about 40 carbon atoms, n is an integer from 0 to 3, L is a ligand that saturates the coordination sphere of cobalt, and x is an integer from 0 to 6. In certain embodiments the ligand, L, is selected from the group consisting of water, hydroxide, alkoxide, oxo, phosphine, phosphite, phosphate, ammonia, amino, amido, pyridyl, sulfate, thioether, sulfide, thiolate, halide, carboxylate, and combinations thereof. In certain embodiments, the cobalt arylsulfonate could be a dimer or higher order multinuclear complex, and the alkylsulfonate substituent or L may be bridging (μ) ligands.

In another embodiment, the cobalt compound can be a cobalt sulfanyl alkanoate as described in U.S. Pat. No. 7,648,949, which is included herein by reference.

In one embodiment, a cobalt reactant can be complexed to a basic nitrogen dispersant succinimide. For example, the cobalt dispersant can be those described in WO2015021129, which is incorporated herein by reference. The basic nitrogen succinimide used to prepare the cobalt complexes has at least one basic nitrogen and is preferably oil-soluble. The succinimide compositions may be post-treated with, e.g., boron, using procedures well known in the art so long as the compositions continue to contain basic nitrogen. The mono and polysuccinimides that can be used to prepare the cobalt complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof. Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight.

A typical compound would be that prepared by reacting polyisobutenyl succinic anhydride and ethylene dipiperazine.

Succinimides having an average molecular weight of 1000 or 1300 or 2300 and mixtures thereof are most preferred.

In another embodiment, the cobalt compound can be a stable colloidal suspension. For example, U.S. Pat. No. 7,884,058 incorporated herein by reference, discloses stable colloidal suspensions of various inorganic oxides. These can be prepared in the presence of an oil phase with a dispersing agent that includes polyalkylene succinic anhydrides, non-nitrogen containing derivatives of a polyalkylene succinic anhydride selected from the group consisting of a polyalkylene succinic acid, a Group I and/or Group II mono- or di-salt of a polyalkylene succinic acid, a polyalkylene succinate ester formed by the reaction of a poly alkylene succinic anhydride or an acid chloride with an alcohol and mixtures thereof, and mixtures thereof and a diluent oil, wherein the stable colloidal suspension is substantially clear.

Generally, the amount of the cobalt containing compound can be from about 0.001 wt. % to about 25 wt. %, from about 0.05 wt. % to about 20 wt. %, or from about 0.1 wt. % to about 15 wt. %, or from about 0.5 wt. % to about 5 wt. %, from about, 1.0 wt. % to about 4.0 wt. %, based on the total weight of the lubricating oil composition.

In an aspect, the present disclosure provides a lubricating engine oil composition for a direct injected, boosted, spark ignited internal combustion engine comprising at least one cobalt-containing compound. In one embodiment, the amount of metal from the at least one cobalt compound is from about 25 to about 3000, from about 50 to about 3000 ppm, from about 100 to about 3000 ppm, from about 200 to about 3000 ppm, or from about 250 to about 2500 ppm, from about 300 to about 2500 ppm, from about 350 to about 2500 ppm, from about 400 ppm to about 2500 ppm, from about 500 to about 2500 ppm, from about 600 to about 2500 ppm, from about 700 to about 2500 ppm, from about 700 to about 2000 ppm, from about 700 to about 1500 ppm. In one embodiment, the amount of metal from the cobalt containing compound is no more than about 2000 ppm or no more than about 1500 ppm.

In one embodiment, the cobalt-containing compound can be combined with conventional lubricating oil detergent additives which contain magnesium and/or calcium. In one embodiment the calcium detergent(s) can be added in an amount sufficient to provide the lubricating oil composition from 0 to about 2400 ppm of calcium metal, from 0 to about 2200 ppm of calcium metal, from 100 to about 2000 ppm of calcium metal, from 200 to about 1800 ppm of calcium metal, or from about 100 to about 1800 ppm, or from about 200 to about 1500 ppm, or from about 300 to about 1400 ppm, or from about 400 to about 1400 ppm, of calcium metal in the lubricating oil composition. In one embodiment the magnesium detergent(s) can be added in an amount sufficient to provide the lubricating oil composition from about 100 to about 1000 ppm of magnesium metal, or from about 100 to about 600 ppm, or from about 100 to about 500 ppm, or from about 200 to about 500 ppm of magnesium metal in the lubricating oil composition.

In one embodiment, the cobalt-containing compound can be combined with conventional lubricating oil detergent additives which contain lithium. In one embodiment the lithium detergent(s) can be added in an amount sufficient to provide the lubricating oil composition from 0 to about 2400 ppm of lithium metal, from 0 to about 2200 ppm of lithium metal, from 100 to about 2000 ppm of lithium metal, from 200 to about 1800 ppm of lithium metal, or from about 100 to about 1800 ppm, or from about 200 to about 1500 ppm, or from about 300 to about 1400 ppm, or from about 400 to about 1400 ppm, of lithium metal in the lubricating oil composition.

In one embodiment, the cobalt-containing compound can be combined with conventional lubricating oil detergent additives which contain sodium. In one embodiment the sodium detergent(s) can be added in an amount sufficient to provide the lubricating oil composition from 0 to about 2400 ppm of sodium metal, from 0 to about 2200 ppm of sodium metal, from 100 to about 2000 ppm of sodium metal, from 200 to about 1800 ppm of sodium metal, or from about 100 to about 1800 ppm, or from about 200 to about 1500 ppm, or from about 300 to about 1400 ppm, or from about 400 to about 1400 ppm, of sodium metal in the lubricating oil composition.

In one embodiment, the cobalt-containing compound can be combined with conventional lubricating oil detergent additives which contain potassium. In one embodiment the potassium detergent(s) can be added in an amount sufficient to provide the lubricating oil composition from 0 to about 2400 ppm of potassium metal, from 0 to about 2200 ppm of potassium metal, from 100 to about 2000 ppm of potassium metal, from 200 to about 1800 ppm of potassium metal, or from about 100 to about 1800 ppm, or from about 200 to about 1500 ppm, or from about 300 to about 1400 ppm, or from about 400 to about 1400 ppm, of potassium metal in the lubricating oil composition.

In one embodiment, the disclosure provides a lubricating engine oil composition comprising a lubricating oil base stock as a major component; and at least one cobalt-containing compound, as a minor component; and wherein the engine exhibits greater than 50% reduced low speed pre-ignition, based on normalized low speed pre-ignition (LSPI) counts per 100,000 engine cycles, engine operation at between 500 and 3,000 revolutions per minute and brake mean effective pressure (BMEP) between 10 and 30 bar, as compared to low speed pre-ignition performance achieved in an engine using a lubricating oil that does not comprise the at least one cobalt-containing compound.

In one aspect, the disclosure provides a lubricating engine oil composition for use in a down-sized boosted engine comprising a lubricating oil base stock as a major component; and at least one cobalt-containing compound, as a minor component; where the downsized engine ranges from about 0.5 to about 3.6 liters, from about 0.5 to about 3.0 liters, from about 0.8 to about 3.0 liters, from about 0.5 to about 2.0 liters, or from about 1.0 to about 2.0 liters. The engine can have two, three, four, five or six cylinders.

In an aspect, the present disclosure provides a method for improving deposit control performance while at the same time preventing or reducing low speed pre-ignition in a direct injected, boosted, spark ignited internal combustion engine, said method comprising the step of lubricating the crankcase of the engine with a lubricating oil composition comprising at least one cobalt containing compound. In one embodiment, the cobalt compound is a cobalt carboxylate as described herein. In one embodiment, the deposit control performance is improved in the TEOST MHT4. Useful amounts to significantly improve the MHT4 can be from about 25 to about 3000, from about 50 to about 3000 ppm, from about 100 to about 3000 ppm, from about 200 to about 3000 ppm, or from about 250 to about 2500 ppm, from about 300 to about 2500 ppm, from about 350 to about 2500 ppm, from about 400 ppm to about 2500 ppm, from about 500 to about 2500 ppm, from about 600 to about 2500 ppm, from about 700 to about 2500 ppm, from about 700 to about 2000 ppm, from about 700 to about 1500 ppm. In one embodiment, the amount of metal from the cobalt containing compound is no more than about 2000 ppm or no more than about 1500 ppm.

In an aspect, the present disclosure provides the use of a at least one cobalt-containing compound for preventing or reducing low speed pre-ignition in a direct injected, boosted, spark ignited internal combustion engine.

Lubricating Oil Additives

In addition to the cobalt compound described herein, the lubricating oil composition can comprise additional lubricating oil additives.

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

The lubricating oil composition of the present invention can contain one or more detergents. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts. A large amount of a metal base may be incorporated by reacting excess metal compound (e.g., an oxide or hydroxide) with an acidic gas (e.g., carbon dioxide).

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.14 wt. %, based on the total weight of the lubricating oil composition.

The lubricating oil composition of the present invention can contain one or more friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the disclosure can contain a molybdenum-containing friction modifier. The molybdenum-containing friction modifier can be any one of the known molybdenum-containing friction modifiers or the known molybdenum-containing friction modifier compositions.

Preferred molybdenum-containing friction modifier is, for example, sulfurized oxymolybdenum dithiocarbamate, sulfurized oxymolybdenum dithiophosphate, amine-molybdenum complex compound, oxymolybdenum diethylate amide, and oxymolybdenum monoglyceride. Most preferred is a molybdenum dithiocarbamate friction modifier.

The lubricating oil composition of the invention generally contains the molybdenum-containing friction modifier in an amount of 0.01 to 0.15 wt. % in terms of the molybdenum content.

The lubricating oil composition of the invention preferably contains an organic oxidation inhibitor in an amount of 0.01-5 wt. %, preferably 0.1-3 wt. %. The oxidation inhibitor can be a hindered phenol oxidation inhibitor or a diarylamine oxidation inhibitor. The diarylamine oxidation inhibitor is advantageous in giving a base number originating from the nitrogen atoms. The hindered phenol oxidation inhibitor is advantageous in producing no NOx gas.

Examples of the hindered phenol oxidation inhibitors include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thio-diethylenebis [3-(3,5-di-t-butyl-4-hydroxyphenyl)propionate], octyl 3-(3,5-di-t-butyl-4-hydroxyphenyl)propionate, octadecyl3-(3,5-di-t-butyl-4-hydroxyphenyl)propionate, and octyl 3-(3,54-butyl-4-hydroxy-3-methylphenyl)propionate, and commercial products such as, but not limited to, Irganox L135® (BASF), Naugalube 531® (Chemtura), and Ethanox 376® (SI Group).

Examples of the diarylamine oxidation inhibitors include alkyldiphenylamine having a mixture of alkyl groups of 3 to 9 carbon atoms, p,p'-dioctyldiphenylamine, phenyl-naphthylamine, phenyl-naphthylamine, alkylated-naphthylamine, and alkylated phenyl-naphthylamine. The diarylamine oxidation inhibitors can have from 1 to 3 alkyl groups.

Each of the hindered phenol oxidation inhibitor and diarylamine oxidation inhibitor can be employed alone or in combination. If desired, other oil soluble oxidation inhibitors can be employed in combination with the above-mentioned oxidation inhibitor(s).

The lubricating oil composition of the invention may further contain an oxymolybdenum complex of succinimide, particularly a sulfur-containing oxymolybdenum complex of succinimide. The sulfur-containing oxymolybdenum complex of succinimide can provide increased oxidation inhibition when it is employed in combination with the above-mentioned phenolic or amine oxidation inhibitors.

In the preparation of lubricating oil formulations it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Processes of Preparing Lubricating Oil Compositions

The lubricating oil compositions disclosed herein can be prepared by any method known to a person of ordinary skill in the art for making lubricating oils. In some embodiments, the base oil can be blended or mixed with the cobalt-containing compounds described herein. Optionally, one or more other additives in additional to the cobalt-containing compounds can be added. The cobalt-containing compounds and the optional additives may be added to the base oil individually or simultaneously. In some embodiments, the cobalt-containing compounds and the optional additives are added to the base oil individually in one or more additions and the additions may be in any order. In other embodiments, the cobalt-containing compounds and the additives are added to the base oil simultaneously, optionally in the form of an additive concentrate. In some embodiments, the solubilizing of the cobalt-containing compounds or any solid additives in the base oil may be assisted by heating the mixture to a temperature from about 25° C. to about 200° C., from about 50° C. to about 150 ° C. or from about 75° C. to about 125° C.

Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

Application of the Lubricating Oil Compositions

The lubricating oil composition disclosed herein may be suitable for use as motor oils (that is, engine oils or crankcase oils), in a spark-ignited internal combustion engine, particularly a direct injected, boosted, engine that is susceptible to low speed pre-ignition.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

The following examples are intended for illustrative purposes only and do not limit in any way the scope of the present invention.

Baseline Formulation

The base line formulation contained a Group 2 base oil, a mixture of primary and secondary dialkyl zinc dithiophosphates in an amount to provide 814 ppm phosphorus to the lubricating oil composition, a mixture of polyisobutenyl succinimide dispersants (borated and ethylene carbonate post-treated), a molybdenum succinimide complex in an amount to provide 187 ppm molybdenum to the lubricating oil composition, an alkylated diphenylamine antioxidant, a borated friction modifier, a foam inhibitor, a pour point depressant, and an olefin copolymer viscosity index improver.

The lubricating oil compositions were blended into a 5W-30 viscosity grade oil.

Cobalt Compound A

The cobalt compound A was a commercially available cobalt compound which was Cobalt(II) 2-ethylhexanoate (11.8% Co) with the chemical formula $Co(C_8H_{15}O_2)_2$.

Cobalt Compound B

The cobalt compound B was a commercially available cobalt compound which was Cobalt(II) Naphthenate (6.02% Co).

Cobalt Compound C

The cobalt compound C was a commercially available cobalt compound which was Cobalt(II) oleate (9.5% Co) with the chemical formula $Co(C_{18}H_{33}O_2)_2$.

Example 1

A lubricating oil composition was prepared by adding 1086 ppm of cobalt from the cobalt-containing compound A and 2286 ppm of calcium from a combination of overbased Ca sulfonate and phenate detergents to the baseline formulation.

Example 2

A lubricating oil composition was prepared by adding 526 ppm of cobalt from the cobalt-containing compound A and 1964 ppm of calcium from a combination of overbased Ca sulfonate and phenate detergents to the baseline formulation.

Example 3

A lubricating oil composition was prepared by adding 1067 ppm of cobalt from the cobalt-containing compound A and 1964 ppm of calcium from a combination of overbased Ca sulfonate and phenate detergents to the baseline formulation,

Comparative Example 1

A lubricating oil composition was prepared by adding 2255 ppm of calcium from a combination of overbased Ca sulfonate and phenate detergents to the baseline formulation.

Comparative Example 2

A lubricating oil composition was prepared by adding 1858 ppm of calcium from a combination of overbased Ca sulfonate and phenate detergents to the baseline formulation.

Comparative Example 3

A lubricating oil composition was prepared by adding 1091 ppm Cobalt from the cobalt-containing compound B and 2427 ppm of calcium from a combination of overbased Ca sulfonate and phenate detergents to the baseline formulation.

Comparative Example 4

A lubricating oil composition was prepared by adding 829 ppm Cobalt from the cobalt-containing compound C and 2218 ppm of calcium from a combination of overbased Ca sulfonate and phenate detergents to the baseline formulation.

LSPI Testing

Low Speed Pre-ignition events were measured in a Ford 2.0L Ecoboost engine. This engine is a turbocharged gasoline direct injection (GDI) engine.

The Ford Ecoboost engine is operated in four-roughly 4 hour iterations. The engine is operated at 1750 rpm and 1.7 MPa break mean effective pressure (BMEP) with an oil sump temperature of 95° C. The engine is run for 175,000 combustion cycles in each stage, and LSPI events are counted.

LSPI events are determined by monitoring peak cylinder pressure (PP) and mass fraction burn (MFB) of the fuel charge in the cylinder. When either or both criteria are met, it can be said that an LSPI event has occurred. The threshold for peak cylinder pressure varies by test, but is typically 4-5 standard deviations above the average cylinder pressure. Likewise, the MFB threshold is typically 4-5 standard deviations earlier than the average MFB (represented in crank angle degrees). LSPI events can be reported as average events per test, events per 100,000 combustion cycles, events per cycle, and/or combustion cycles per event. The results for this test is shown below.

TABLE 1

Ford LSPI Test Results

| | Ex. 1 | Comp. Ex. 1 | Comp. Ex. 3 | Comp. Ex. 4 | Ex. 2 | Ex. 3 | Comp Ex. 2 |
|---|---|---|---|---|---|---|---|
| Co (ppm) | 1086 | 0 | 1091 | 829 | 526 | 1067 | 0 |
| Ca (ppm) | 2286 | 2255 | 2427 | 2218 | 1964 | 1964 | 1858 |
| Average LSPI Cycles* | 7.75 | 19.25 | 20.25 | 27.75 | 6.25 | 3.25 | 9.25 |
| Average LSPI Cycles* > 90 bar | 3.25 | 13.25 | 5.75 | | 2.5 | 1 | 4.5 |
| Average LSPI Cycles* > 100 bar | 2.5 | 10.75 | 4 | | 2.5 | 0.75 | 4.25 |

TABLE 1-continued

| Ford LSPI Test Results | Ex. 1 | Comp. Ex. 1 | Comp. Ex. 3 | Comp. Ex. 4 | Ex. 2 | Ex. 3 | Comp Ex. 2 |
|---|---|---|---|---|---|---|---|
| Average LSPI Cycles* > 110 bar | 2.25 | 9.0 | 3.75 | | 2.25 | 0.5 | 3.75 |
| Average LSPI Cycles* > 120 bar | 2.0 | 8.25 | 3 | | 2.0 | 0.5 | 3.5 |

*Counts all cycles of LSPI where both MFB02 and Peak Pressure Requirements are met The data shows that Applicant's inventive examples comprising cobalt provided significantly better LSPI performance both in terms of number of events and also the number of severe LSPI events than the comparative examples which did not contain cobalt in the Ford engines. Severity is reduced by decreasing the number of high pressure events (i.e. over 120 bar) that can damage an engine.

TEOST MHT4

TEOST MHT4 (ASTM D7097-16a) is designed to predict the deposit-forming tendencies of engine oil in the piston ring belt and upper piston crown area. Correlation has been shown between the TEOST MHT procedure and the TU3MH Peugeot engine test in deposit formation. This test determines the mass of deposit formed on a specially constructed test rod exposed to repetitive passage of 8.5 g of engine oil over the rod in a thin film under oxidative and catalytic conditions at 285° C. Deposit-forming tendencies of an engine oil under oxidative conditions are determined by circulating an oil-catalyst mixture comprising a small sample (8.4 g) of the oil and a very small (0.1 g) amount of an organo-metallic catalyst. This mixture is circulated for 24 hours in the TEOST MHT instrument over a special wire-wound depositor rod heated by electrical current to a controlled temperature of 285° C. at the hottest location on the rod. The rod is weighed before and after the test. Deposit weight of 35 mg is considered as pass/fail criteria.

A copy of this test method can be obtained from ASTM International at 100 Barr Harbor Drive, PO Box 0700, West Conshohocken, Pa. 19428-2959 and is herein incorporated for all purposes.

Example 4

A lubricating oil composition was prepared by adding 280 ppm of cobalt from the cobalt-containing compound A and 2029 ppm of calcium from a combination of overbased Ca sulfonate and phenate detergents to the baseline formulation,

TABLE 2

| TEOST MHT4 | Ex. 4 | Ex. 2 | Ex. 3 | Comp Ex. 2 |
|---|---|---|---|---|
| Co (ppm) | 280 | 526 | 1067 | 0 |
| Ca (ppm) | 2029 | 1964 | 1964 | 1858 |
| TEOST MHT4 deposits (mg) | 27.8 | 18.25 | 4.4 | 36.4 |

The data shows that Applicant's inventive examples comprising cobalt provided significantly better deposit control performance over those formulations that did not contain cobalt. Thus, applicants have found a way to improve LSPI performance while at the same time significantly improving deposit control performance.

What is claimed is:

1. A method for preventing or reducing low speed pre-ignition in a direct injected, boosted, spark ignited internal combustion engine, said method comprising the step of lubricating the crankcase of the engine with a lubricating oil composition comprising from about 25 to about 3000 ppm of metal from at least one cobalt-containing compound, based on the total weight of the lubricating oil composition;

wherein the cobalt-containing compound is a cobalt carboxylate having the following structure (Formula 2)

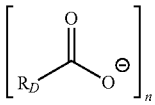

where α is the +2 or +3 oxidation state, $R_D$ is a branched and saturated aliphatic hydrocarbon moiety having from 3 to about 30 carbon atoms, n is an integer from 1 to 3, L is absent or a ligand that saturates the coordination sphere of cobalt, and x is an integer from 0 to 6.

2. The method of claim 1, wherein the engine is operated under a load with a break mean effective pressure (BMEP) of from about 12 to about 30 bars.

3. The method of claim 1, wherein the engine is operated at speeds between 500 and 3,000 rpm.

4. The method of claim 1, wherein the lubricating oil further comprises a detergent selected from calcium detergents, magnesium detergents, sodium detergents, lithium detergents, and potassium detergents.

5. The method of claim 4, wherein the detergent is a carboxylate, salicylate, phenate, or sulfonate detergent.

6. The method of claim 1, wherein the lubricating oil further comprises a molybdenum containing compound.

7. The method of claim 1, wherein the lubricant composition further comprises at least one other additive selected from an ashless dispersant, an ashless antioxidant, a phosphorus-containing anti-wear additive, a friction modifier, and a polymeric viscosity modifier.

8. A method for improving deposit control performance while at the same time preventing or reducing low speed pre-ignition in a direct injected, boosted, spark ignited internal combustion engine, said method comprising the step of lubricating the crankcase of the engine with a lubricating oil composition comprising at least one cobalt containing compound; wherein the cobalt-containing compound is a cobalt carboxylate having the following structure:

(Formula 2)

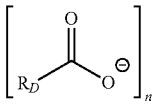

where α is the +2 or +3 oxidation state, $R_D$ is a branched and saturated aliphatic hydrocarbon moiety having from 3 to about 30 carbon atoms, n is an integer from 1 to 3, L is absent or a ligand that saturates the coordination sphere of cobalt, and x is an integer from 0 to 6.

9. The method of claim 8, wherein the engine is operated under a load with a break mean effective pressure (BM EP) of from about 12 to about 30 bars.

10. The method of claim 8, wherein the engine is operated at speeds between 500 and 3,000 rpm.

11. The method of claim 8, wherein the lubricating oil further comprises a detergent selected from calcium detergents, magnesium detergents, sodium detergents, lithium detergents, and potassium detergents.

12. The method of claim 11, wherein the detergent is a carboxylate, salicylate, phenate, or sulfonate detergent.

13. The method of claim 8, wherein the lubricating oil further comprises a molybdenum containing compound.

14. The method of claim 8, wherein the lubricant composition further comprises at least one other additive selected from an ashless dispersant, an ashless antioxidant, a phosphorus-containing anti-wear additive, a friction modifier, and a polymeric viscosity modifier.

* * * * *